US007841116B2

(12) United States Patent
Whelan

(10) Patent No.: US 7,841,116 B2
(45) Date of Patent: Nov. 30, 2010

(54) SYSTEM AND METHOD FOR DECORATING THE FACE OF ARCHITECTURAL COLUMNS

(76) Inventor: Michael E Whelan, 16210 Barrineau Pl., Lutz, FL (US) 33549

( * ) Notice: Subject to any disclaimer, the term of this patent is extended or adjusted under 35 U.S.C. 154(b) by 0 days.

(21) Appl. No.: 12/431,235

(22) Filed: Apr. 28, 2009

(65) Prior Publication Data

US 2010/0269384 A1 Oct. 28, 2010

(51) Int. Cl.
*G09F 17/00* (2006.01)

(52) U.S. Cl. ..... 40/604; 40/606.12; 40/603; 40/607.03; 40/591; 426/87; 428/44

(58) Field of Classification Search ..... 40/506, 40/607.12, 607.01, 606.12, 606.14
See application file for complete search history.

(56) References Cited

U.S. PATENT DOCUMENTS 367,508 A 8/1887 Dubois
1,096,580 A 5/1914 Webb
3,366,493 A 1/1968 Stump
3,609,894 A * 10/1971 Miller ..... 40/655
3,722,562 A 3/1973 Stegmuller
5,383,296 A * 1/1995 Vecchione et al. ..... 40/604
5,555,696 A 9/1996 Morrison, III et al.
5,863,632 A 1/1999 Bisker
6,040,023 A 3/2000 Salerno
6,056,083 A 5/2000 Daniell
2007/0041189 A1 2/2007 Mchinnis et al.

* cited by examiner

*Primary Examiner*—Lesley Morris
*Assistant Examiner*—Shin Kim
(74) *Attorney, Agent, or Firm*—Michael J. Colitz, III; Gray Robinson, P.A.

(57) ABSTRACT

Disclosed is a system for decorating architectural columns. The system includes opposing dowels that are contained within cylindrical housings. Banner-type decorations extend between the cylindrical housings. The cylindrical housings also include upper and lower access openings. Strap assemblies are also included that extend around the dowels via the access openings. The banner-type decorations are secured to the face of an architectural column by securing the upper and lower strap assemblies.

9 Claims, 10 Drawing Sheets

36
38
44
42

20
24
26
26
26
26
48
46
24

20
24
3
3
24
26
26
26
26

FIG. 4
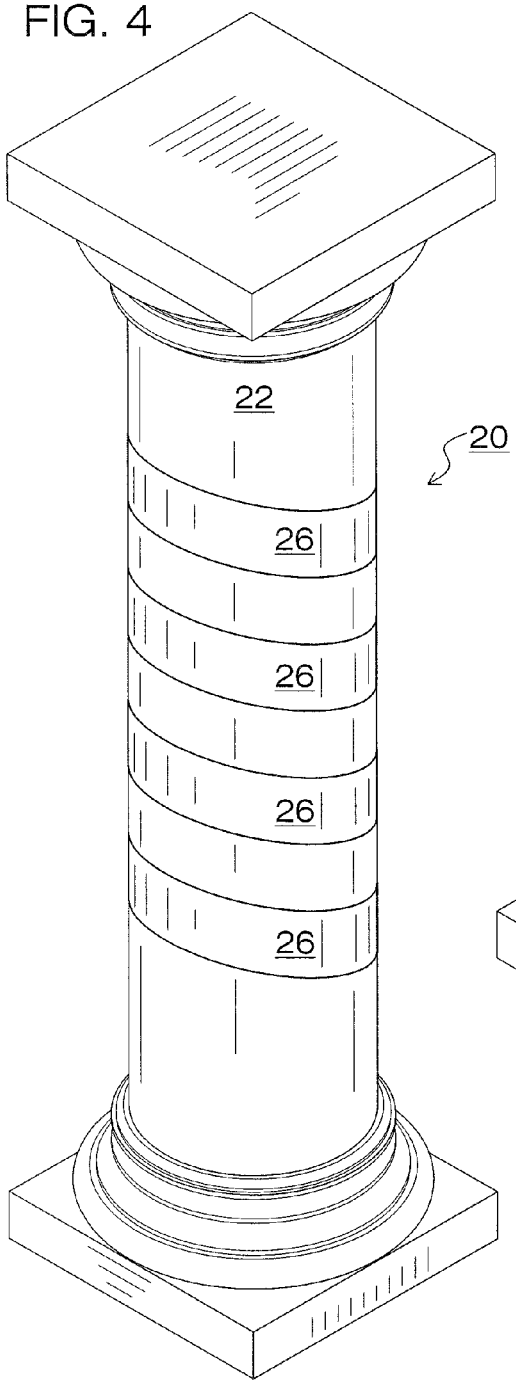
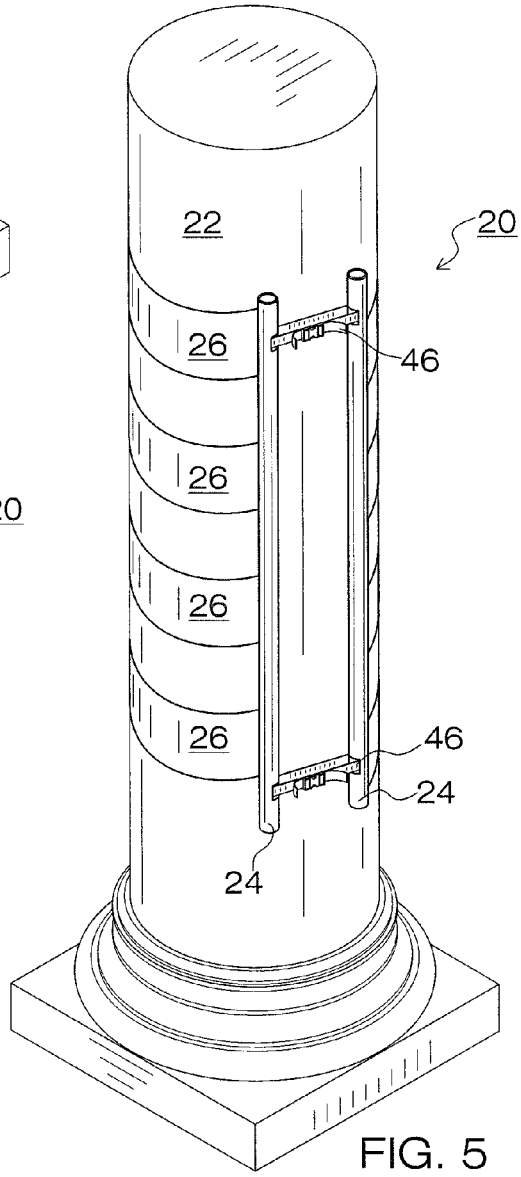
FIG. 5

FIG. 9
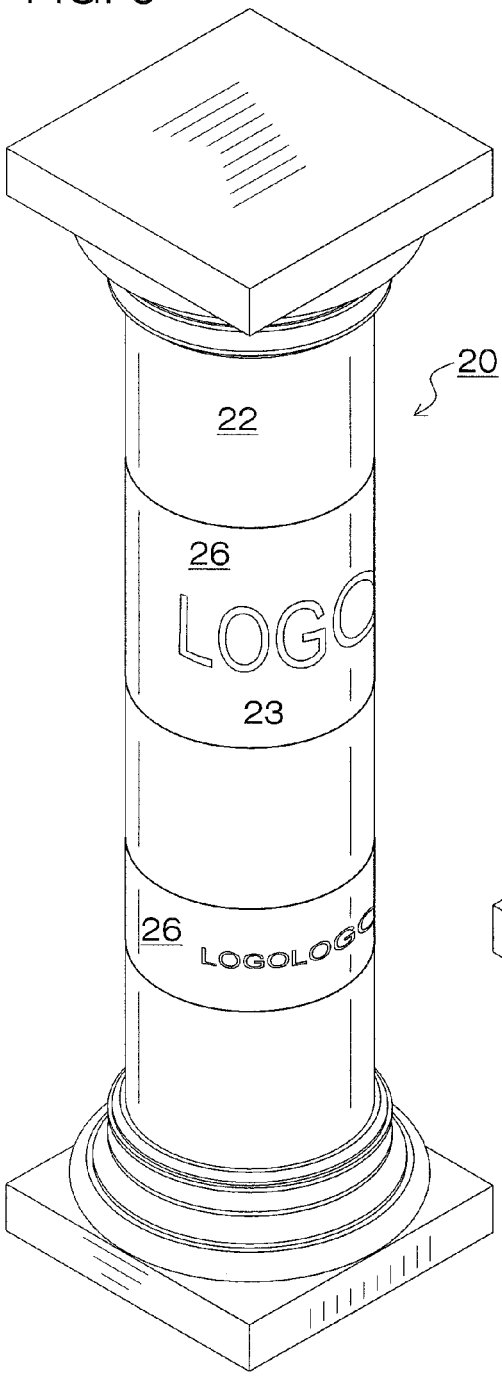
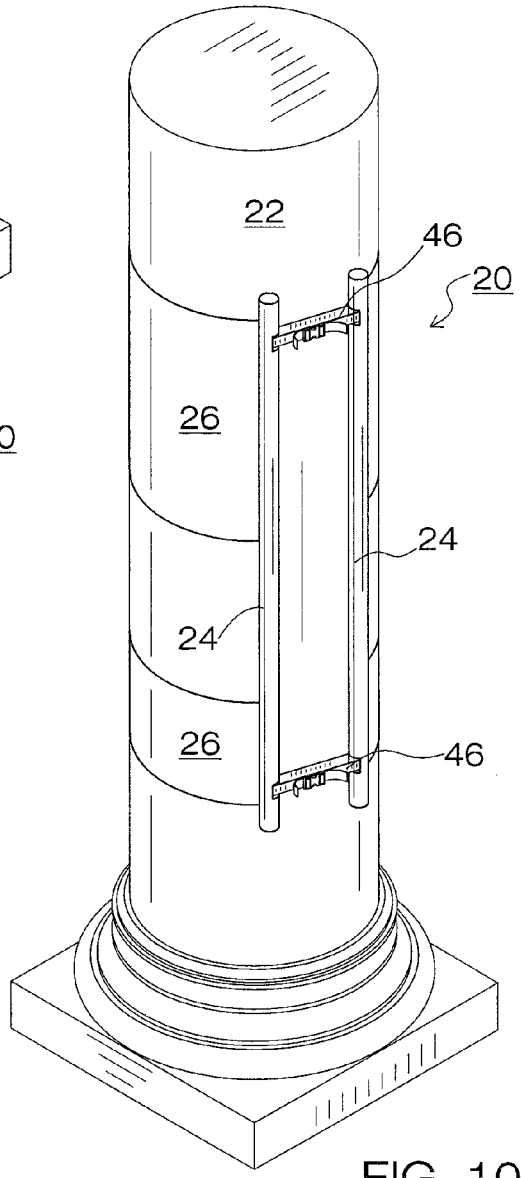
FIG. 10

FIG. 14
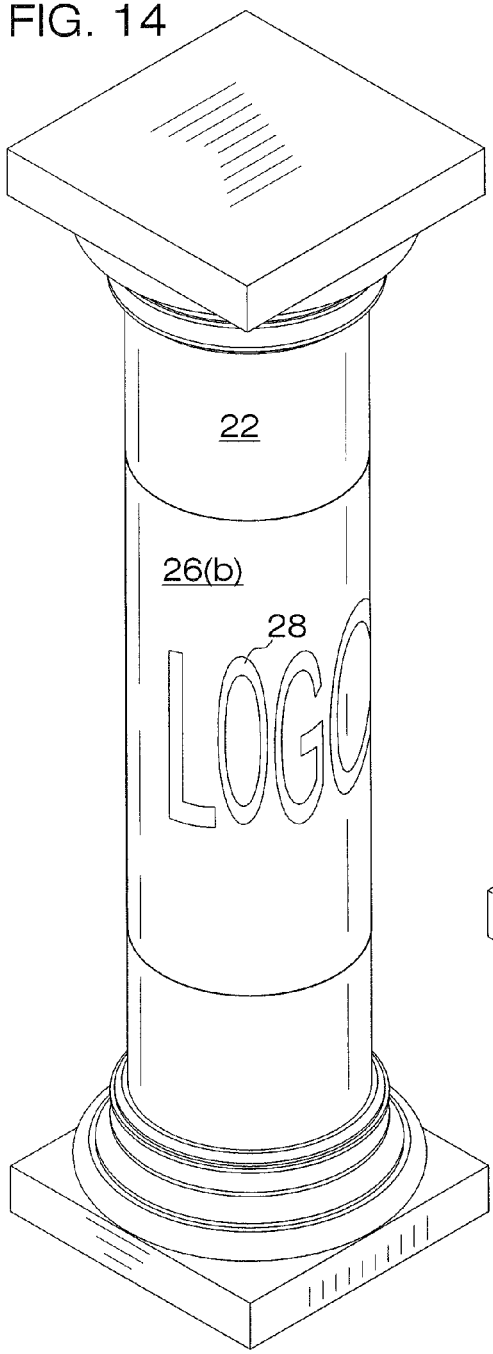
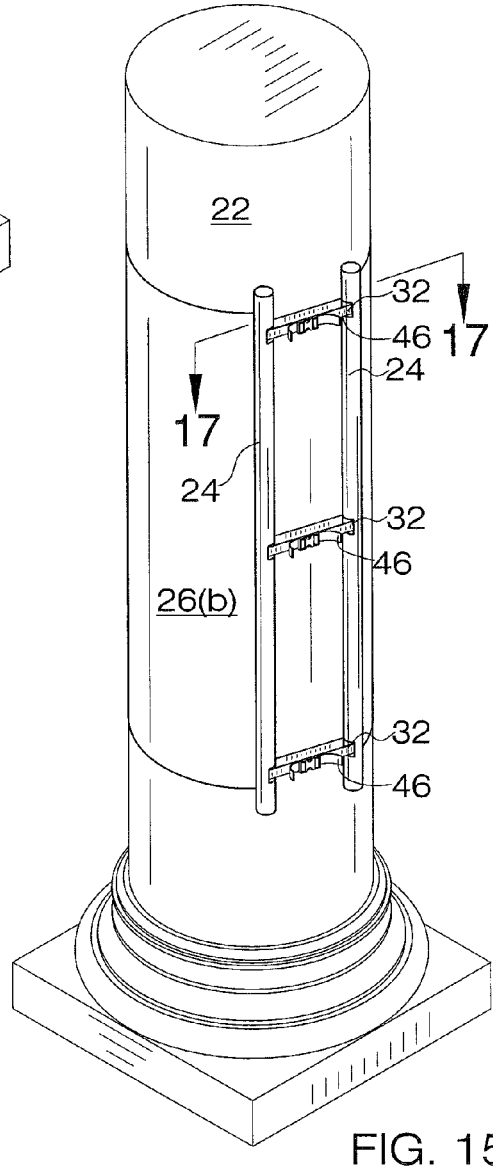
FIG. 15

SYSTEM AND METHOD FOR DECORATING THE FACE OF ARCHITECTURAL COLUMNS

BACKGROUND OF THE INVENTION

1. Field of the Invention

This invention relates to system for decorating architectural columns. More specifically, the present invention relates to a system whereby banner-type displays can be easily and quickly fitted over the face of architectural columns.

2. Description of the Background Art

The use of banner-type displays is well known. These displays are used for decoration, advertising and as a means for displaying messages. It is also known in the art to secure such banner-type displays to columns, such as architectural columns. For instance, column born displays are used to display important announcements such as the birth of a child or to welcome family members home after an absence.

For instance, U.S. Pat. No. 1,096,580 to Webb discloses an advertising sign that is adapted to be secured to a post. The sign includes an oblong body and opposing clamping arms. Likewise, U.S. Pat. No. 367,508 to Dubois discloses a method of constructing ornamental masonry columns. The method contemplates the use of elongated prisms that are connected to suitable surfaces by way of cement.

Although the referenced inventions each achieve their own individual objectives, they all suffer from common drawbacks. Namely, prior art system generally require hardware or other complicated fastening systems for securing the banner to the column. These approaches are not adequate insomuch as they do not provide a secure fastening system that can be easily and quickly removed.

Thus, there exists a need in the art for a system to quickly and securely fasten a banner-type advertisement to a column. The present invention is aimed at fulfilling these needs.

SUMMARY OF THE INVENTION

It is therefore one of the objectives of this invention to enable banner-type decorations to be easily and securely fastened to the face of a column.

It is also an object of the present invention to allow banner-type decorations to be removably secured to a column without the need for any anchor attachments to the column itself.

It is also an object of the present invention to allow banner-type decorations to be secured to the face of a column via a buckle type attachment mechanism, whereby the banner-type decoration can be easily taken down or secured.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 4 is a perspective view of an architectural column decorated with the system of the present invention.

FIG. 5 is a perspective view showing the back side of a column decorated with the system of the present invention.

FIG. 9 a perspective view showing the banner-type decoration of FIG. 7 secured to an architectural column.

FIG. 10 is a rear perspective view of the system in place upon a column.

FIG. 14 is a perspective view of the full length banner-type decoration in place upon an architectural column.

FIG. 15 is a rear perspective view of the full length banner-type decoration in place upon an architectural column.

Similar reference characters refer to similar parts throughout the several views of the drawings.

DETAILED DESCRIPTION OF THE PREFERRED EMBODIMENT

The present invention relates to a system for decorating architectural columns. The system includes opposing dowels that are contained within cylindrical housings. Banner-type decorations are secured between the cylindrical housings. The cylindrical housings also include upper and lower access openings. Strap assemblies are secured around the dowels via the access openings. The banner-type decorations can be secured to the face of an architectural column by securing the upper and lower strap assemblies about the periphery of the column. The various components of the present invention, and the manner in which they interrelate, will be described in greater detail hereinafter.

Figures 1, 2, 3:
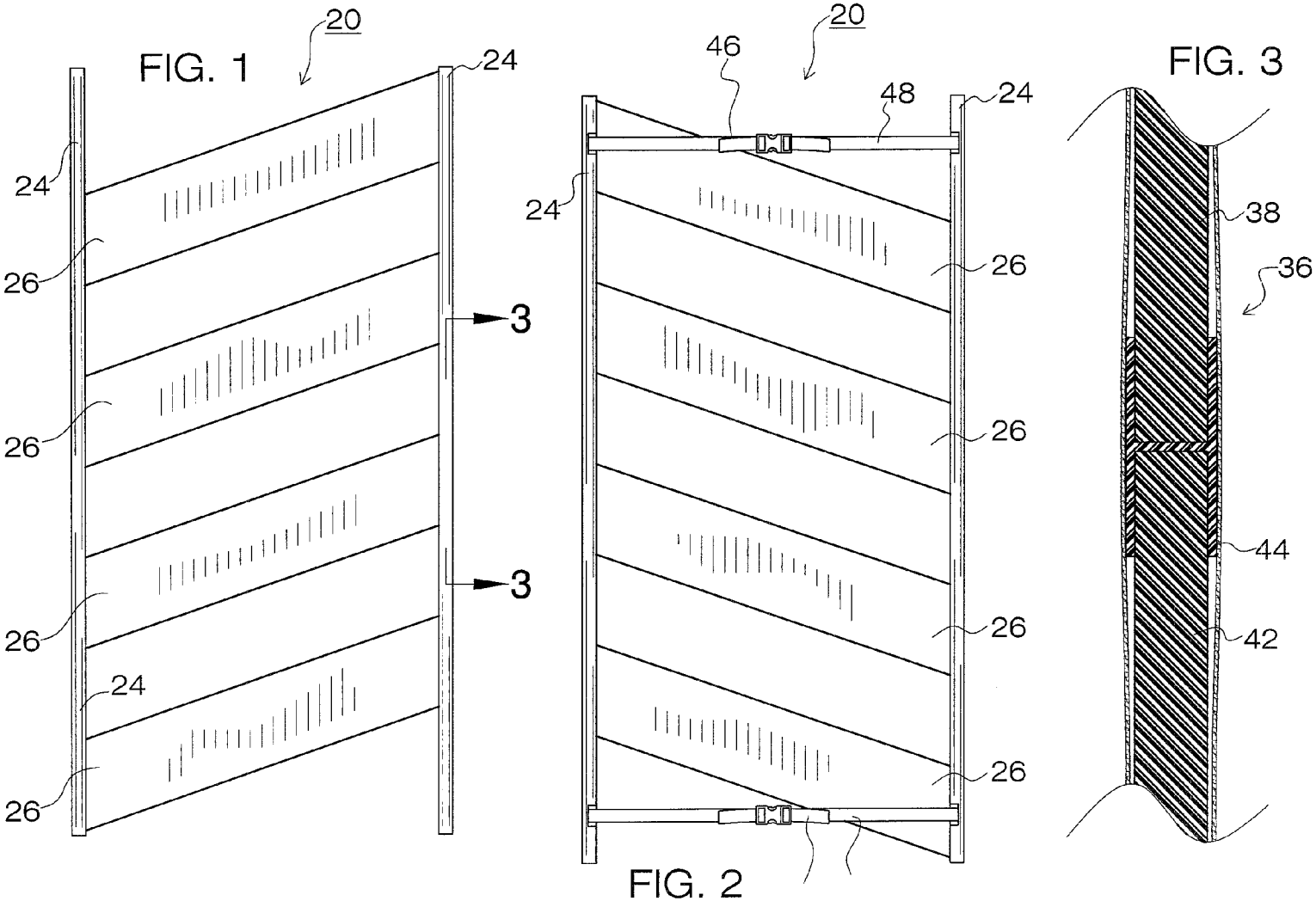
FIG. 1 is a front elevational view of the system of the present invention.
FIG. 2 is rear elevational view of the system of the present invention.
FIG. 3 is a sectional view of one of the cylindrical housings taken along line 3-3 of FIG. 1

With reference now to FIGS. 1-5, the various components of system 20 are depicted. FIGS. 1-3 depict system 20 by itself, while FIGS. 4-5 depict system 20 positioned upon an architectural column 22. Although system 20 is depicted as being used on an architectural column 22, those skilled in the art will appreciate a wide variety of columns than can benefit from the present invention.

Figure 8:
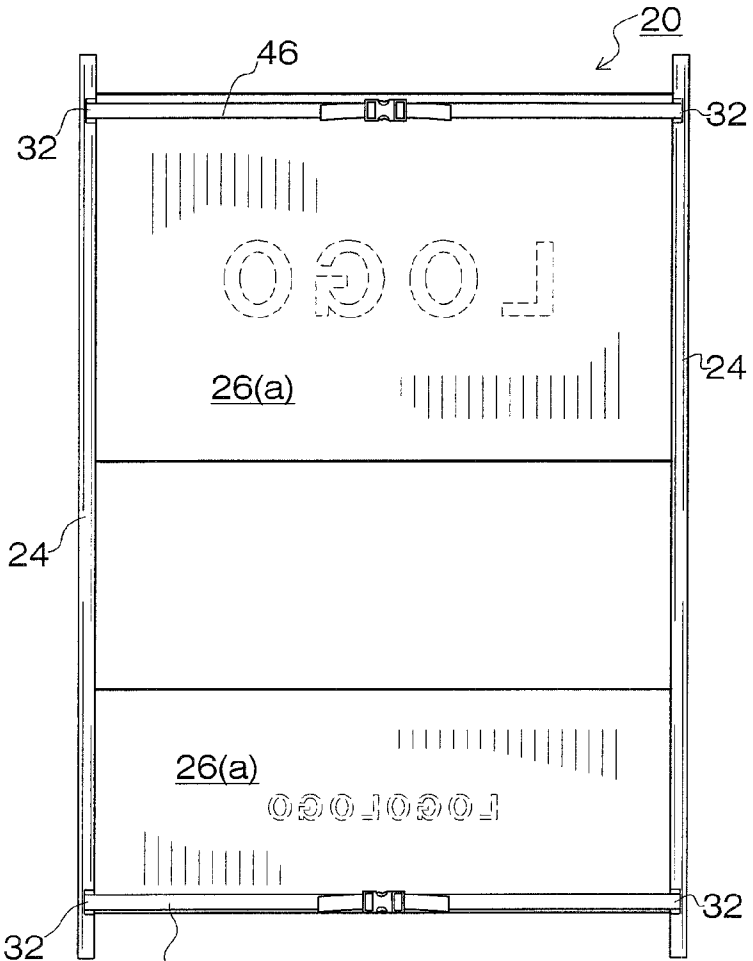
FIG. 8 is a rear elevational view of the system of FIG. 7.
Figure 7:
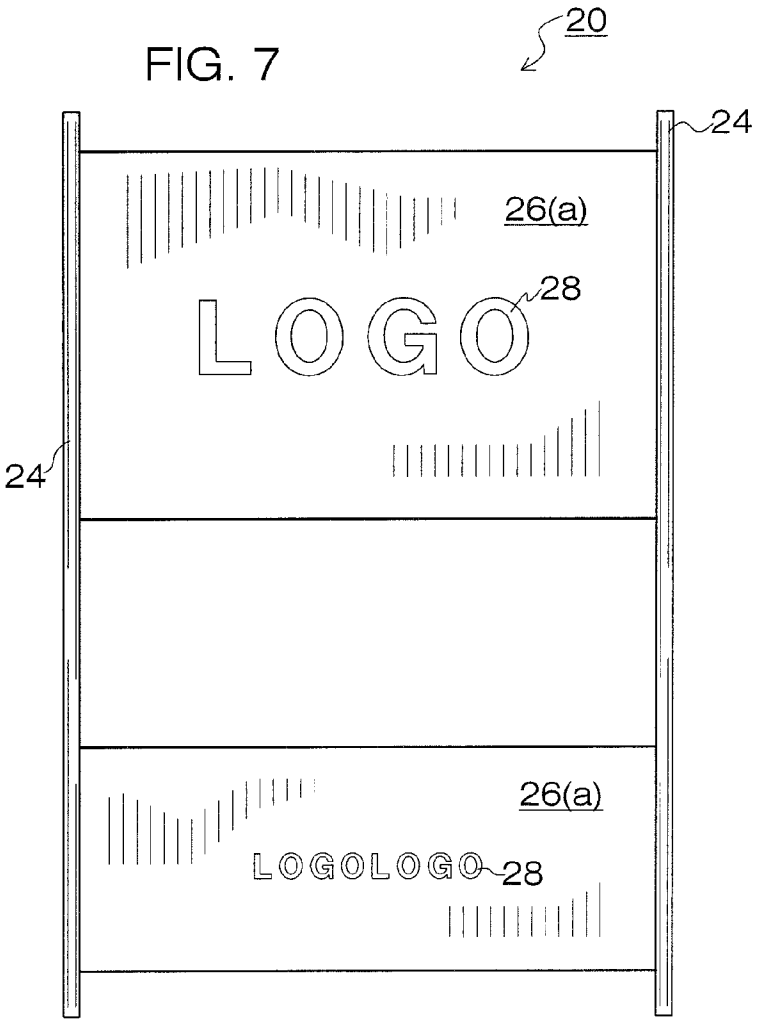
FIG. 7 is a front elevational view showing one possible banner-type decoration in accordance with the present invention.
Figure 11:
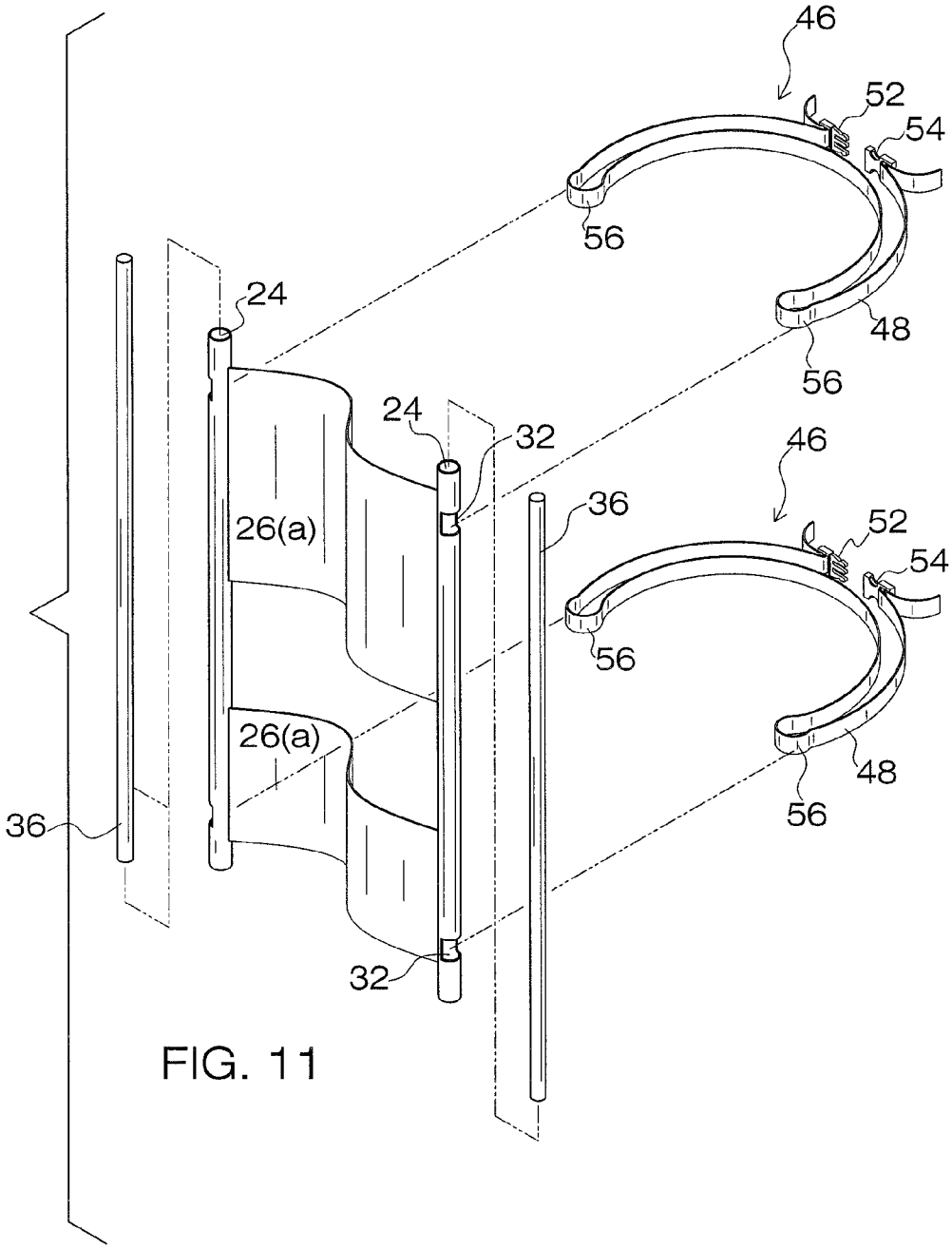
FIG. 11 is an exploded view of the system of FIG. 7.
Figure 13:
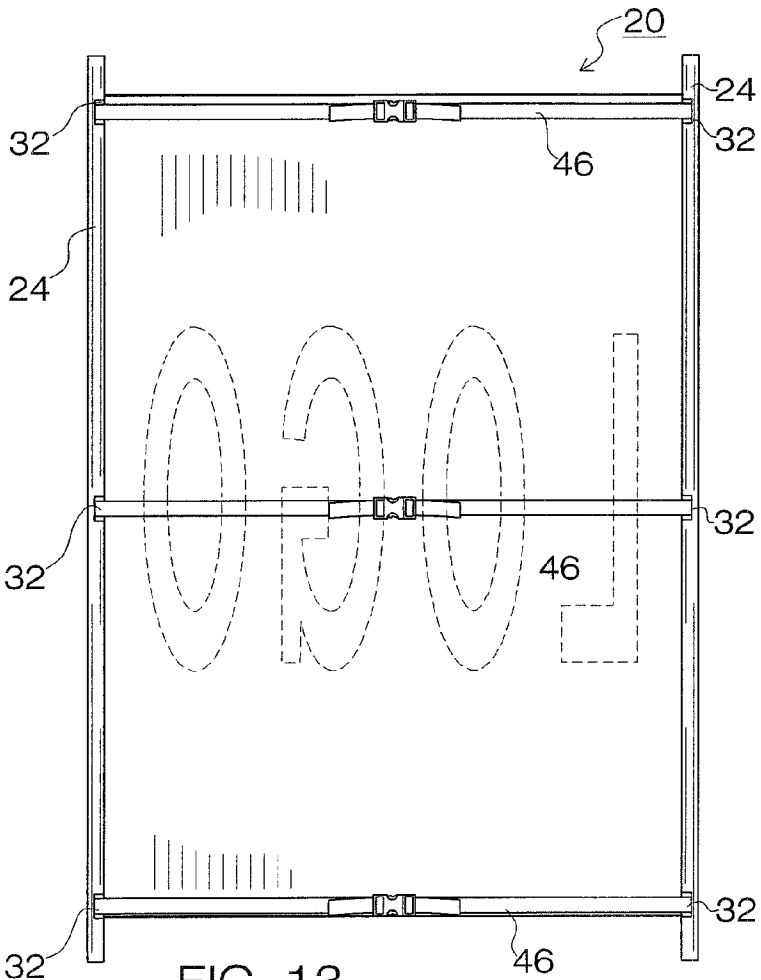
FIG. 13 is a rear elevational view of the full length banner-type decoration of FIG. 12.
Figure 12:
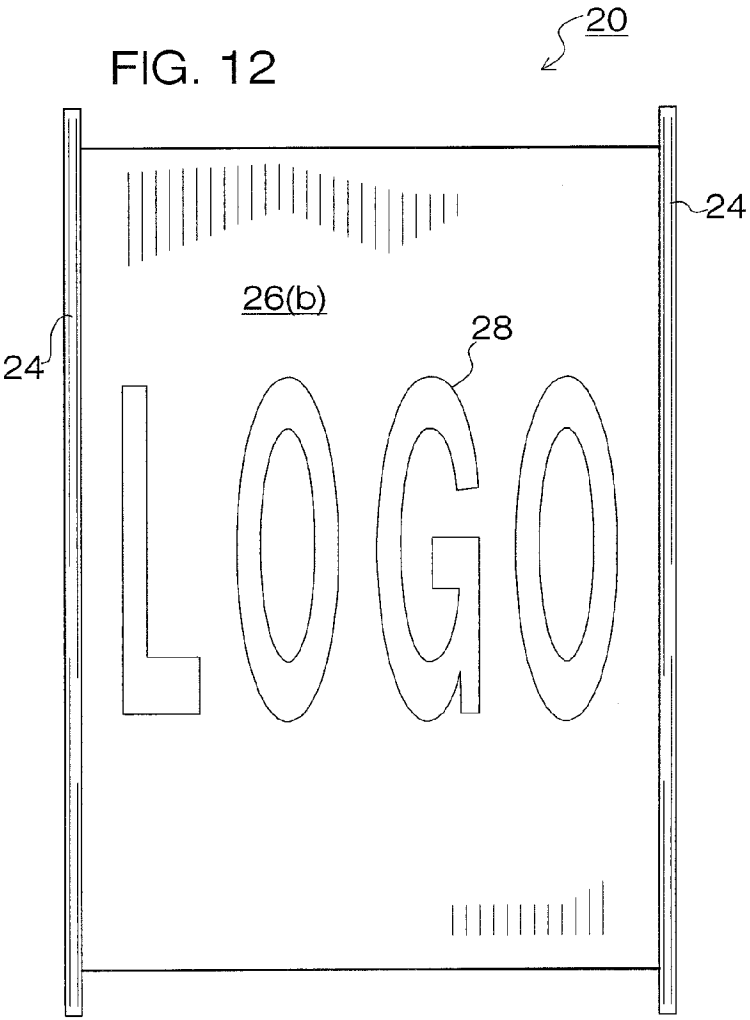
FIG. 12 is a front elevational view showing a full length banner-type decoration being used in conjunction with the system of the present invention.
Figure 16:
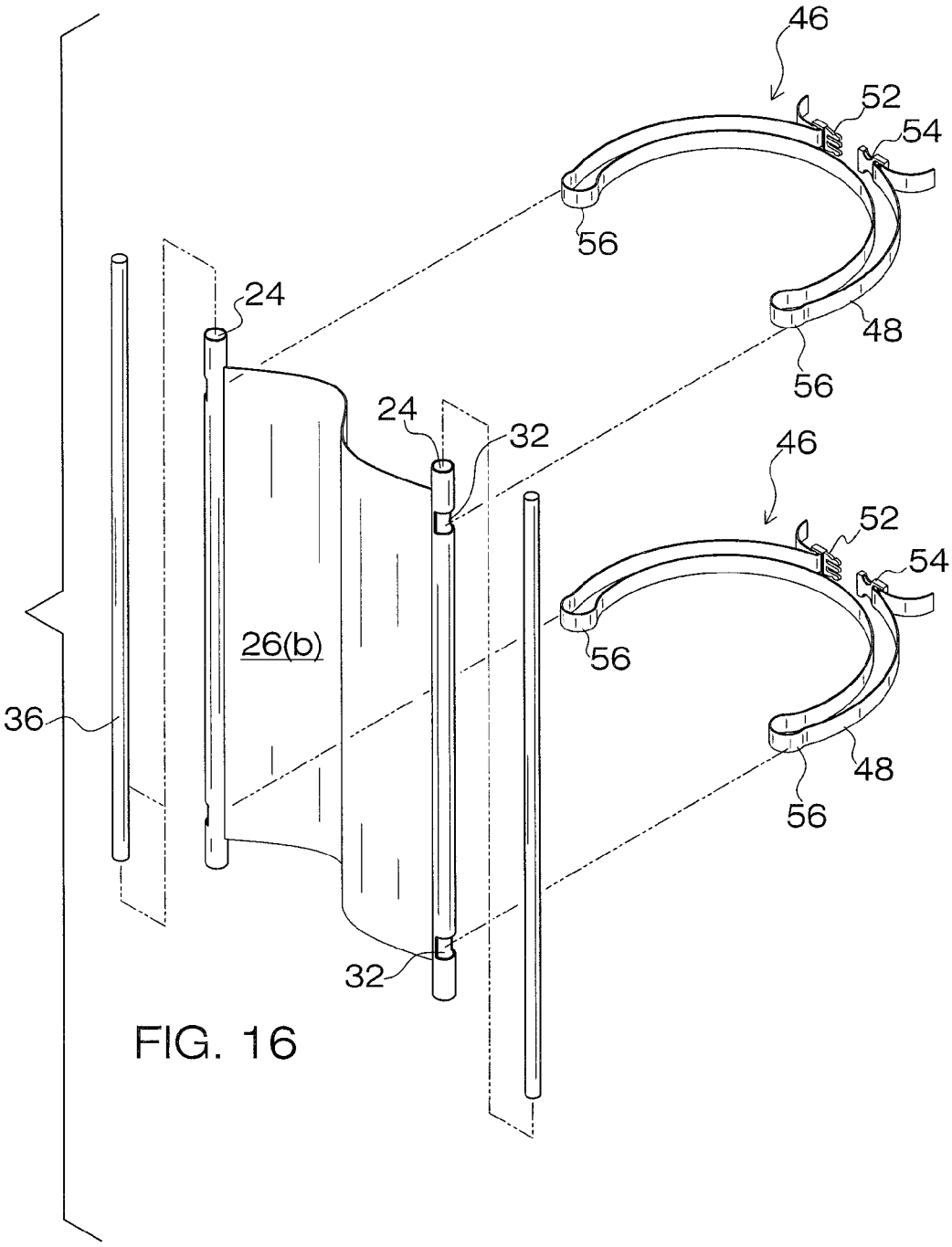
FIG. 16 is an exploded view of the system of FIG. 15.
Figure 17:
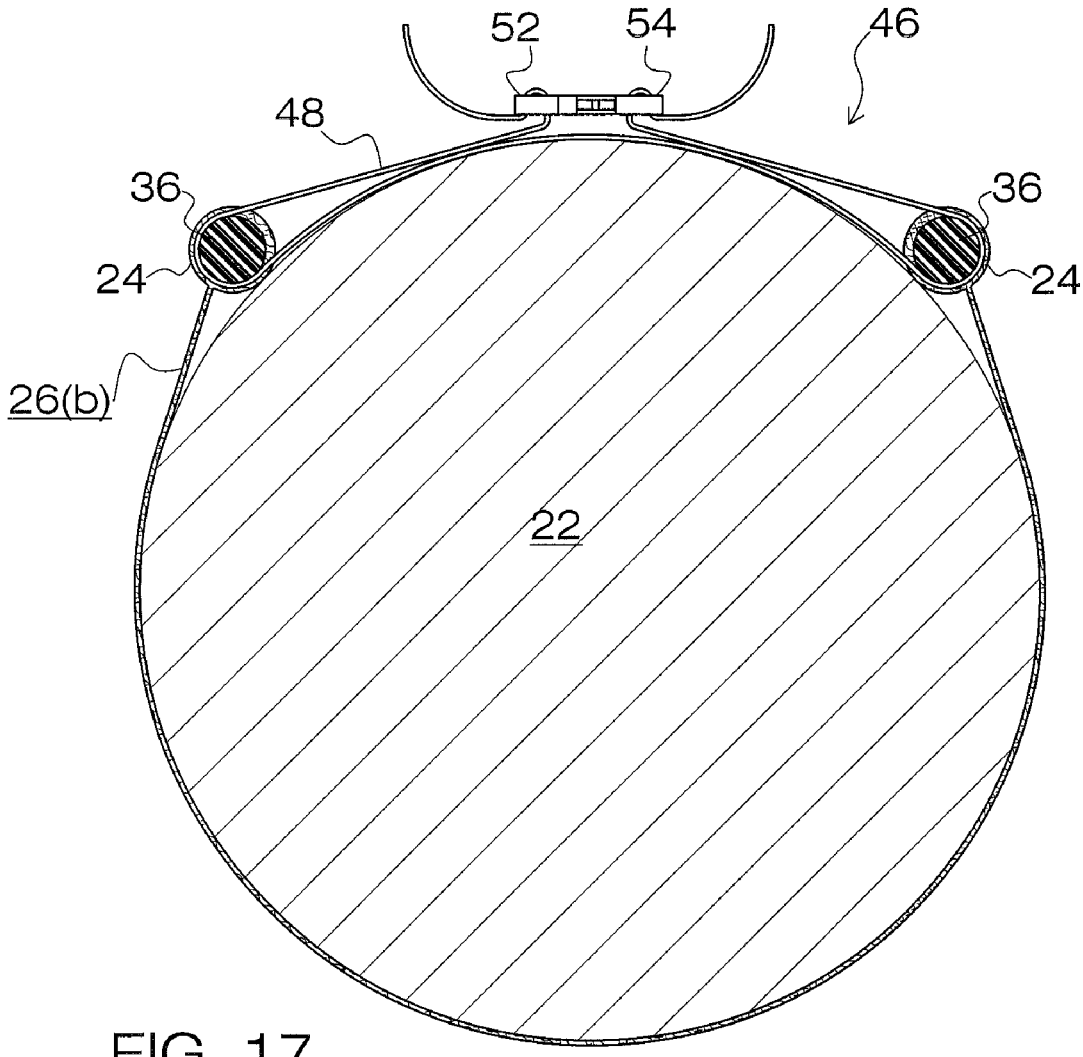
FIG. 17 is a sectional view taken along line 17-17 of FIG. 15.

As noted, system 20 includes opposing cylindrical housings 24 between which one or more banners 26 extends. The particular embodiment illustrated in FIG. 2 includes four diagonally extending banners 26 are secured between the opposing housings 24. However, other banner arrangements can easily be employed with the present invention. For example, FIGS. 7-9 illustrate two horizontally extending banners 26(*a*); FIGS. 12-14 illustrates one elongated banner 26(*b*). Text or other indicia 28 can be included on the banner. Those of ordinary skill in the art will appreciate still yet other banner arrangements that can be employed with system 20 of the present invention.

FIG. 2 further illustrates the upper and lower access openings 32 within each cylindrical housing 24. These openings 32 permit access to the hollow interior 34 of the respective housing 24 and permit straps to be secured to dowels positioned within the housing, as is described in more detail hereinafter. Cylindrical housings can come in a variety of lengths, with the overall length depending upon the size of the banner decoration being hung. The inner diameter should be sufficient to allow for the passage of internal dowels 36.

Housings 24 can be formed from a variety of materials, such as metal, wood or plastic. A weather resistant plastic material is preferred. FIGS. 1 and 2 further illustrate a plurality of banner-type decorations 26 extending diagonally between and secured to the pair of cylindrical housings 24. When secured upon a column, such as column 22, these decorations result in a striped or "candy-cane" presentation.

FIG. 3 is a cross section showing the preferred dowel assembly 36 of the present invention. As illustrated, dowel assembly 36 preferably includes first and second dowels components, 38 and 42, that are interconnected in an end to end fashion. The interconnection is achieved by way of a connector element 44. More specifically, connector element 44 includes opposing female receptacles that accept the ends of the dowel components, 38 and 42, via a friction connection. By way of connector element 44, a series of two or more dowels, 38 and 42, can be employed such that a series of banner displays 20 can be stacked an in end to end fashion to thereby accommodate larger displays. Alternatively, for smaller displays, the use of a connector can be eliminated by using a single dowel. In either event, and as further illustrated by FIG. 3, the resulting dowel assembly 36 is positionable within the hollow interior 34 of a respective housing 24.

Figure 6:
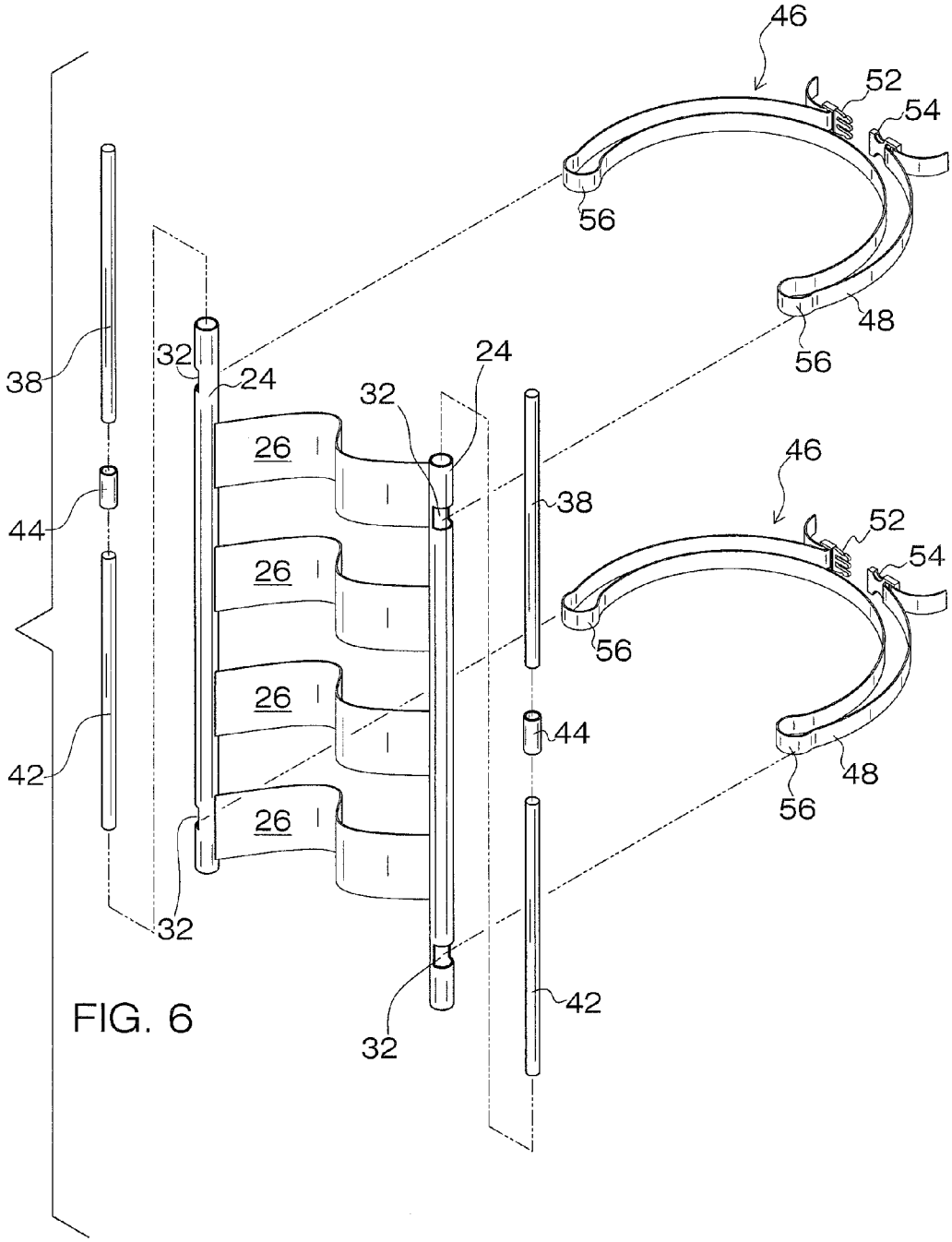
FIG. 6 is an exploded view of the system of the present invention.

The strap assemblies 46 are next described. As noted, the preferred system utilizes upper and lower strap assemblies 46 to secure the upper and lower extents of the housings 24. However, the strap assemblies 46 can be positioned at other locations along housings 24. With reference now to FIG. 6, it is shown that each strap assembly 46 includes an intermediate length of strap 48 with interlocking male and female buckles (52 and 54) at opposing ends thereof. Strap 48 can be formed, for example, from EPDM Rubber. Banners 26 can be formed from a nylon fabric. The male and female buckles (52 and 54) can be formed from a variety of impact resistant plastics. In the depicted embodiment, the male buckle 52 includes opposing biased teeth that can be removably positioned within corresponding apertures of the female buckle 54.

With continuing reference to FIG. 6, the positioning of the straps 48 relative to the dowels 36 is depicted. Namely, the intermediate extent of the lower strap 48 is positioned within the lower access openings 32. This permits the intermediate extent of the strap 48 to be wrapped around the respective dowels 36. The intermediate extent of the upper strap 48 is secured in a similar fashion. Namely, the intermediate extent 48 of the strap is secured within the upper access openings 32 such that it is secured about the respective dowels 36. The foregoing arrangement can be achieved by forming loops 56 along the intermediate length of the straps 48 and thereafter positioning loops 56 within the upper and lower access openings 32. Dowels 36 (consisting of dowel components 38 and 42) are then slidably positioned within the cylindrical housings 24. In this manner, the straps 48 become locked within cylindrical housings 24.

Although the preferred embodiment has been described as employing two sets of strap assemblies 46 and two sets of access openings 32, other arrangements are possible. For instance, for the full length banner depicted in FIGS. 12-15, the strap assemblies 46 are included for connection to dowels 36 along three access openings 32. Those skilled in the art will appreciate still yet other arrangements.

With reference now to FIGS. 5-6, the manner of securing system 20 to a column 22 is described. First, the banner-type decoration 26 is positioned over the face of column 22. Care should be taken to ensure that the decoration is positioned for best visibility. Second, the opposing cylindrical housings 24 are then positioned adjacent to one another at a location behind the column 22. With the housings 24 so secured, the banner-type decorations 26 should be taught over the column face. Finally, the banner-type decorations are secured by locking the male and female buckles (52 and 54) of the upper and lower strap assemblies 46. If necessary, slack can be removed from the straps to ensure an appropriate fit.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A system for decorating the face of an architectural column, the system comprising in combination:

a pair of cylindrical housings, each housing having a hollow interior and upper and lower access openings;

a plurality of banner-type decorations extending diagonally between and secured to the pair of cylindrical housings;

a pair of dowels, each dowel comprising first and second components that are releasably secured to one another by way of a connector, each dowel positioned within the hollow interior of a respective cylindrical housing;

upper and lower strap assemblies, each strap assembly having an intermediate length of strap with interlocking male and female buckles at opposing ends thereof, the lower strap assembly being positioned within the lower access openings such that the intermediate length of strap is secured about the respective dowels, the upper strap assembly being positioned within the upper access openings such that the intermediate strap is secured about the respective dowels;

whereby the plurality of banner-type decorations can be secured over the face of the architectural column by placing the pair of cylindrical housings adjacent the column and thereafter locking the male and female buckles of the upper and lower strap assemblies.

2. A system for decorating the face of a column comprising:

a pair of housings, each housing having a hollow interior and an access opening;

a banner extending between and secured to the pair of housings;

a pair of dowels, each dowel positioned within the hollow interior of a respective housing;

a strap assembly having an intermediate length of strap with interlocking ends, the strap assembly being positioned within the access openings such that the intermediate length of strap is secured about the respective dowels;

whereby the banner can be secured over the face of the column by placing the pair of housings adjacent the column and thereafter locking the ends of the strap assembly.

3. The system as described in claim 2 wherein a plurality of banner-type decorations extend between the pair of housings.

4. The system as described in claim 2 wherein indicia is included on the face of the banner.

5. The system as described in claim 2 wherein the housings include upper and lower access openings and wherein the banner is secured by upper and lower strap assemblies that are secured to the upper and lower access openings.

6. The system as described in claim 2 wherein the dowel is formed from two dowel components that are interconnected in an end to end fashion.

7. The system as described in claim 2 wherein the ends of the strap are connected by mating male and female connectors.

8. The system as described in claim 2 wherein the housings are cylindrical in shape.

9. The system as described in claim 2 wherein two horizontal banners extend between the two housings.

* * * * *

UNITED STATES PATENT AND TRADEMARK OFFICE

CERTIFICATE OF CORRECTION

PATENT NO. : 7,841,116 B2
APPLICATION NO. : 12/431235
DATED : November 30, 2010
INVENTOR(S) : Michael E Whelan It is certified that error appears in the above-identified patent and that said Letters Patent is hereby corrected as shown below:

Column 3, Line 18, after "housings", insert -- 24 --

Signed and Sealed this
Eighth Day of February, 2011

David J. Kappos

David J. Kappos
*Director of the United States Patent and Trademark Office*